US011430366B2

(12) United States Patent
Baek et al.

(10) Patent No.: US 11,430,366 B2
(45) Date of Patent: Aug. 30, 2022

(54) DISPLAY DEVICE AND METHOD FOR CONTROLLING THE SAME

(71) Applicant: LG Display Co., Ltd., Seoul (KR)

(72) Inventors: Sang Hun Baek, Paju-si (KR); Myung Kook Moon, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/520,656

(22) Filed: Nov. 6, 2021

(65) Prior Publication Data

US 2022/0208056 A1 Jun. 30, 2022

(30) Foreign Application Priority Data

Dec. 30, 2020 (KR) ..... 10-2020-0187845

(51) Int. Cl.
*G09G 3/20* (2006.01)

(52) U.S. Cl.
CPC ..... *G09G 3/20* (2013.01); *G09G 2320/045* (2013.01); *G09G 2320/048* (2013.01)

(58) Field of Classification Search
CPC ..... G09G 3/20; G09G 2320/04–048
See application file for complete search history.

(56) References Cited

U.S. PATENT DOCUMENTS

| | | | | |
|---|---|---|---|---|
| 8,054,252 | B2 * | 11/2011 | Tada | G09G 3/3208 345/76 |
| 9,779,686 | B2 * | 10/2017 | Richards | G02B 27/0172 |
| 9,959,807 | B2 * | 5/2018 | Lee | G09G 3/3208 |
| 10,018,838 | B2 * | 7/2018 | Richards | G09G 5/003 |
| 10,839,746 | B2 * | 11/2020 | Ohnishi | G09G 3/30 |
| 11,151,917 | B1 * | 10/2021 | Kim | G06F 1/1626 |
| 2013/0176324 | A1 * | 7/2013 | Yamashita | G09G 5/02 345/589 |
| 2021/0193011 | A1 * | 6/2021 | Chang | G09G 3/3208 |

* cited by examiner

*Primary Examiner* — Gene W Lee
(74) *Attorney, Agent, or Firm* — Fenwick & West LLP

(57) ABSTRACT

A display device according to an embodiment of the present disclosure includes a display panel including a plurality of pixels, a memory in which deterioration data of the pixels is accumulated and stored and compensation data with respect to the deterioration data is stored, and a controller configured to apply the compensation data to input image data to generate output image data, and when an increase amount of deterioration data of the pixels generated as the output image data is displayed on the display panel is equal to or greater than a threshold, to accumulate the increase amount of the deterioration data to store the deterioration data in the memory.

20 Claims, 7 Drawing Sheets

DISPLAY DEVICE AND METHOD FOR CONTROLLING THE SAME

This application claims the benefit of Korean Patent Application No. 10-2020-0187845, filed on Dec. 30, 2020, which is hereby incorporated by reference as if fully set forth herein.

BACKGROUND OF THE INVENTION

Field of the Invention

The present disclosure relates to a display device and a method for controlling the same.

Discussion of the Related Art

Pixel circuit elements included in a display device deteriorate as driving time elapses. Deterioration of pixels may decrease luminance, causing reduction in display quality or generation of afterimage.

Accordingly, to improve display quality by compensating for deterioration of pixels, various deterioration compensation methods such as a method of determining a deterioration compensation amount based on a time for which pixels are used are under development.

However, conventional deterioration compensation methods have limited resources such as memories for storing related data and thus have problems that it is difficult to perform accurate compensation and the lifespan of products is also limited according to the lifespan of a memory.

SUMMARY OF THE INVENTION

Accordingly, the present disclosure is directed to a display device and a method for controlling the same that substantially obviate one or more problems due to limitations and disadvantages of the related art.

An object of the present disclosure is to provide a display device and a method for controlling the same to improve the lifespan of a memory for deterioration compensation.

To achieve these objects and other advantages and in accordance with the purpose of the invention, as embodied and broadly described herein, a display device includes a display panel including a plurality of pixels, a memory in which deterioration data of the pixels is accumulated and stored and compensation data with respect to the deterioration data is stored, and a controller configured to apply the compensation data to input image data to generate output image data for display on the display panel, and when an increase amount of deterioration data of the pixels generated as the output image data is displayed on the display panel is equal to or greater than a threshold, to accumulate the increase amount of the deterioration data to store the deterioration data in the memory.

The controller may increase a deterioration data storage period as a cumulative driving time of the display panel increases.

The controller may decrease a deterioration data storage frequency as the cumulative driving time of the display panel increases.

The memory may include (N-1)-th stored deterioration data, (N-2)-th stored deterioration data, and (N-1)-th compensation data for compensating for the (N-1)-th stored deterioration data.

The controller may calculate previous deterioration data on the basis of a difference between the (N-2)-th stored deterioration data and the (N-1)-th stored deterioration data, when a difference between newly generated deterioration data generated as output image data compensated according to the (N-1)-th compensation data is displayed on the display panel and the previous deterioration data is equal to or greater than the threshold, accumulate the newly generated deterioration data in addition to the (N-1)-th stored deterioration data, and store the accumulated data as N-th deterioration data.

The controller may include a drive amount accumulator configured to accumulate current drive amounts of the pixels on the basis of the output image data output to the display panel, a data controller configured to determine whether the increase amount of the deterioration data is equal to or greater than the threshold on the basis of deterioration data previously stored in the memory and a cumulative current drive amount of the drive amount accumulator, to reflect the cumulative current drive amount in the deterioration data when the increase amount of the deterioration data is equal to or greater than the threshold, and to accumulate and store the deterioration data in the memory, and a compensation data calculator configured to calculate compensation data with respect to the deterioration data to update previous compensation data in the memory.

The deterioration data controller may include a subtractor configured to load (N-1)-th deterioration data and (N-2)-th deterioration data stored in the memory and to calculate a difference value between the (N-1)-th deterioration data and the (N-2)-th deterioration data, a comparator configured to compare a difference between the difference value and the cumulative current drive amount to the threshold and to output the cumulative current drive amount if the difference is equal to or greater than the threshold, and an adder configured to add the cumulative current drive amount to the (N-1)-th deterioration data and to output N-th deterioration data to the memory.

The controller may include an image compensator configured to apply the compensation data to the input image data to generate output image data in which deterioration of the pixels has been compensated.

In another aspect of the present disclosure, a method for controlling a display device including a display panel including a plurality of pixels, and a memory in which deterioration data of the pixels is accumulated and stored and compensation data with respect to the deterioration data is stored includes applying the compensation data to input image data to generate output image data for display on the display panel, accumulating deterioration data of the pixel generated as the output image data is displayed on the display panel, and accumulating an increase amount of the deterioration data and storing the deterioration data in the memory if the increase amount of the deterioration data is equal to or greater than a threshold.

A deterioration data storage period may increase as a cumulative driving time of the display panel increases A deterioration data storage frequency may decrease as the cumulative driving time of the display panel increases.

The accumulating deterioration data of the pixel generated as the output image data is displayed on the display panel may include accumulating a current drive amount of the pixels on the basis of the output image data.

The storing the deterioration data in the memory if the increase amount of the deterioration data is equal to or greater than a threshold may include calculating previous deterioration data on the basis of a difference between (N-2)-th deterioration data and (N-1)-th deterioration data stored in the memory, determining whether a difference between an accumulation value of the current drive amount of the pixels and the previous deterioration data is equal to or greater than the threshold, and reflecting the accumulation value of the current drive amount of the pixels in the (N-1)-th stored deterioration data and storing the resultant value as N-th deterioration data if the difference is equal to or greater than the threshold.

In still another embodiment, a display device comprises a display panel including a plurality of pixels, a memory in which deterioration data of the pixels is accumulated and stored and compensation data corresponding to the deterioration data is stored, and a controller configured to apply the compensation data to input image data to generate output image data for display on the display panel, and to accumulate an increase amount of the deterioration data of the pixels generated as the output image data is displayed on the display panel and to store the deterioration data in the memory at irregular deterioration data storage intervals determined according to the increase amount of the deterioration data of the pixels.

In some embodiments, the controller decreases the deterioration data storage interval as a cumulative driving time of the display panel increases in a first range of the cumulative driving time. In other embodiments, the controller increases the deterioration data storage interval as the cumulative driving time of the display panel increases in a second range of the cumulative driving time greater than the first range of the cumulative driving time.

In some embodiments, the controller updates the deterioration data in the memory at an increasing frequency in a first range of efficiency drop of the display panel. In other embodiments, the controller updates the deterioration data in the memory at a decreasing frequency in a second range of efficiency drop of the display panel greater than the first range of efficiency drop of the display panel.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
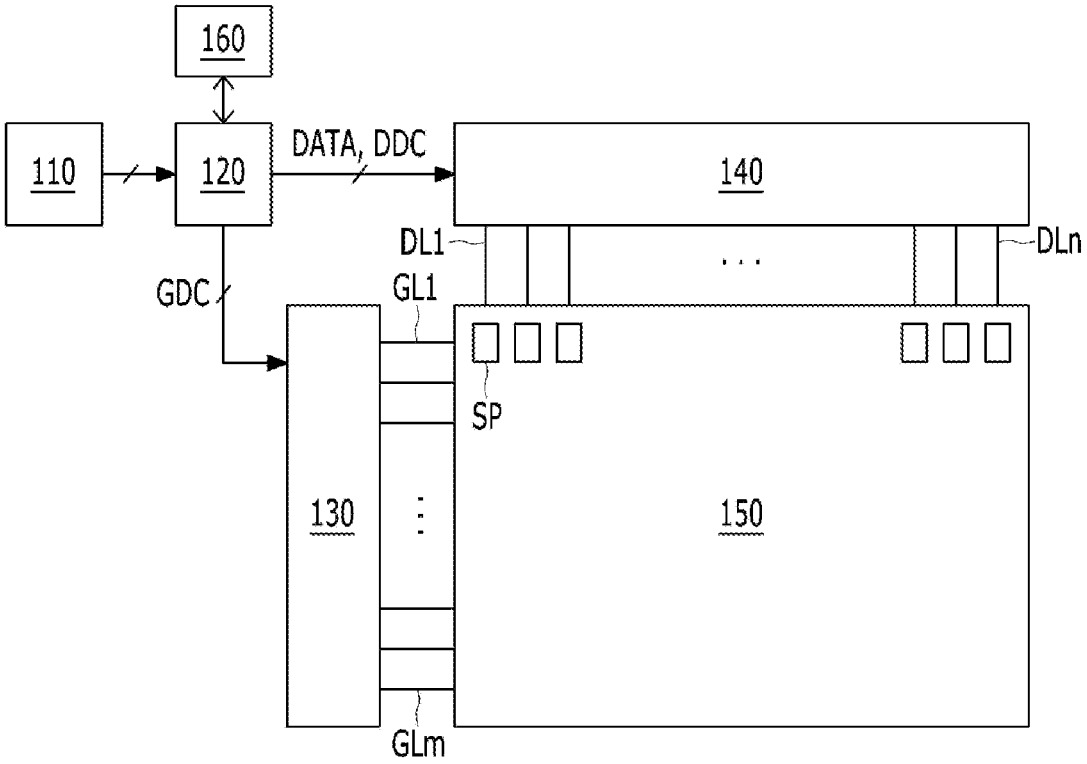
FIG. 1 is a block diagram schematically illustrating a display device according to an embodiment of the present disclosure.

The advantages and features of the present disclosure and the way of attaining the same will become apparent with reference to embodiments described below in detail in conjunction with the accompanying drawings. The present disclosure, however, is not limited to the embodiments disclosed hereinafter and may be embodied in many different forms. Rather, these exemplary embodiments are provided so that this disclosure will be through and complete and will fully convey the scope to those skilled in the art. Thus, the scope of the present disclosure should be defined by the claims.

The shapes, sizes, ratios, angles, numbers, and the like, which are illustrated in the drawings in order to describe various embodiments of the present disclosure, are merely given by way of example, and therefore, the present disclosure is not limited to the illustrations in the drawings. The same or extremely similar elements are designated by the same reference numerals throughout the specification. In the present specification, when the terms "comprise", "include", and the like are used, other elements may be added unless the term "only" is used. An element described in the singular form is intended to include a plurality of elements unless the context clearly indicates otherwise.

In interpretation of constituent elements included in the various embodiments of the present disclosure, the constituent elements are interpreted as including an error range even if there is no explicit description thereof.

In the description of the various embodiments of the present disclosure, when describing positional relationships, for example, when the positional relationship between two parts is described using "on", "above", "below", "beside", or the like, one or more other parts may be located between the two parts unless the term "directly" or "closely" is used.

Although terms such as, for example, "first" and "second" may be used to describe various elements, these terms are merely used to distinguish the same or similar elements from each other. Therefore, in the present specification, an element modified by "first" may be the same as an element modified by "second" within the technical scope of the present disclosure unless otherwise mentioned.

Throughout the present specification, the same reference numerals designate the same constituent elements.

A display device described below may be implemented as a television set, a video player, a personal computer (PC), a home theater, a smartphone, a virtual reality (VR) device, or the like. An example in which the display device is an organic light emitting display device based on organic light-emitting diodes (OLEDs) (light-emitting elements) will be described below. However, the display device described below may be implemented based on inorganic light-emitting diodes.

Hereinafter, embodiments of the present disclosure will be described in detail with reference to the attached drawings. In the following embodiments, a display device is an organic light emitting display device including organic light-emitting elements. However, the technical scope of the present disclosure is not limited to the organic light emitting display device and may be applied to an inorganic light emitting display device including inorganic light-emitting elements.

In the following description of the present disclosure, a detailed description of known functions and configurations incorporated herein will be omitted when it may obscure the subject matter of the present disclosure.

Figure 2:
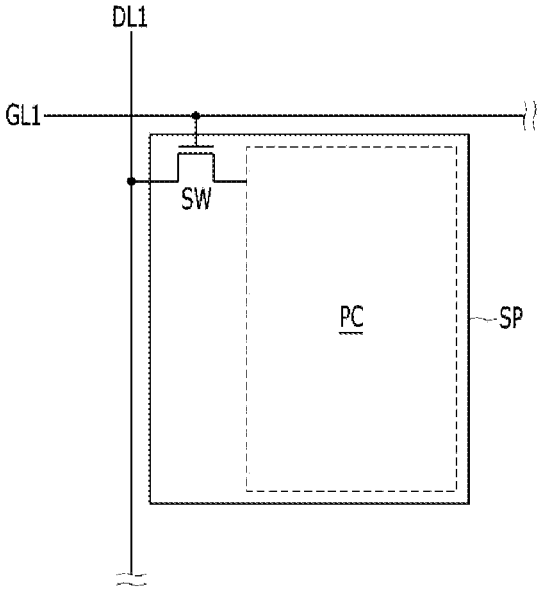
FIG. 2 is a block diagram schematically illustrating a sub-pixel included in the display device of FIG. 1.

FIG. 1 is a block diagram schematically illustrating a display device according to an embodiment of the present disclosure and FIG. 2 is a block diagram schematically illustrating a sub-pixel included in the display device of FIG. 1.

As illustrated in FIG. 1 and FIG. 2, a display device according to an embodiment of the present disclosure may include an image provider 110, a timing controller 120, a memory 160, a scan driver 130, a data driver 140, a display panel 150, and a power supply (not shown).

The image provider 110 (or a host system) outputs various driving signals along with an image data signal supplied from the outside or an image data signal stored in an internal memory. The image provider 110 may provide the data signal and the driving signals to the timing controller 120.

A plurality of data lines DL1 . . . DLn, a plurality of sensing lines (not shown), and a plurality of scan lines GL1 . . . GLm are arranged in the display panel 150. Sub-pixels SP are disposed at intersections of the plurality of data lines DL1 . . . DLn, the plurality of sensing lines (not shown), and the plurality of scan lines GL1 . . . GLm.

The display panel 150 may be manufactured based on a hard or flexible substrate such as a glass, silicon or polyimide substrate. Sub-pixels emitting light may be composed of red, green, and blue sub-pixels or red, green, blue, and white sub-pixels. A single sub-pixel SP has a sub-pixel circuit PC including a switching transistor SW, a driving transistor (not shown), a storage capacitor (not shown), and an organic light-emitting diode (not shown).

The scan driver 130 outputs a scan signal (or a scan voltage) in response to a gate timing control signal GDC supplied from the timing controller 120. The scan driver 130 provides the scan signal to the sub-pixels included in the display panel 150 through the scan lines GL1 . . . GLm. The scan driver 130 may be configured as an integrated circuit (IC) or directly formed on the display panel 150 in a gate-in-panel structure, but the present disclosure is not limited thereto.

The data driver 140 converts a data signal DATA into an analog data voltage in response to a data timing control signal DDC supplied from the timing controller 120 and provides the analog data voltage to the display panel 150 in a display mode for displaying an image. The data driver 140 may be configured as an IC and mounted on the display panel 150 or a printed circuit board, but the present disclosure is not limited thereto.

The power supply (not shown) generates a high-level voltage EVDD and a low-level voltage EVSS based on an external input voltage and outputs the high-level voltage EVDD and the low-level voltage EVSS to the display panel 150. In the display mode, the sub-pixels SP of the display panel 150 can emit light in response to the high-level voltage EVDD and the low-level voltage EVSS.

The timing controller 120 outputs the gate timing control signal GDC for controlling operation timing of the scan driver 130, the data timing control signal DDC for controlling operation timing of the data driver 140, and various synchronization signals (vertical synchronization signal Vsync and horizontal synchronization signal Hsync). The timing controller 120 provides a data signal DATA supplied from the image provider 110 along with the data timing control signal DDC to the data driver 140. The timing controller 120 may be configured as an integrated circuit (IC) and may be mounted on a printed circuit board, but the present disclosure is not limited thereto.

The timing controller 120 may store deterioration data of the sub-pixels SP and compensation data with respect to the deterioration data in the memory 160. The deterioration data may be accumulated and stored for each sub-pixel SP or each block of sub-pixels SP. The timing controller 120 counts pieces of deterioration data of the sub-pixels SP generated as output image data is displayed on the display panel 150. When an increase amount of deterioration data is equal to or greater than a threshold, the timing controller 120 may accumulate the increase amount of the deterioration data and store the deterioration data in the memory 160. The deterioration data may include an accumulation amount of a driving current applied to the sub-pixels or include cumulative driving time. The timing controller 120 may compensate for input image data using the deterioration data stored in the memory 160 to generate output image data in which deterioration of the sub-pixels SP has been compensated.

Although the timing controller 120, the scan driver 130, and the data driver 140 have been described as separate components, at least one of the timing controller 120, the scan driver 130, and the data driver 140 may be integrated in an IC according to a display device implementation method.

Deterioration data of the sub-pixels SP is accumulated and stored in the memory 160 and compensation data with respect to the deterioration data is also stored in the memory 160. The memory 160 may be provided outside the timing controller 120. The memory 160 can read/write data and preserve data in a state in which power is not supplied thereto. The memory 160 may include a flash memory, an erasable programmable read-only memory (EPROM), an electrically erasable programmable read-only memory (EEPROM), a phase change random access memory (PRAM), a resistance random access memory (RRAM), a nano-floating gate memory (NFGM), a polymer random access memory (PoRAM), a magnetic random access memory (MRAM), a ferroelectric random access memory (FRAM), etc.

Figure 3:
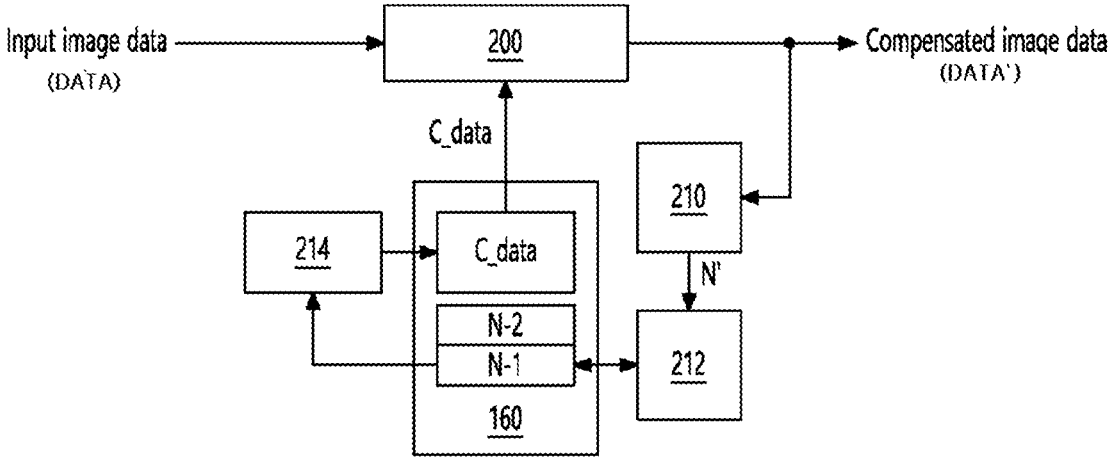
FIG. 3 is a control block diagram of a deterioration compensation system according to an embodiment of the present disclosure.

FIG. 3 is a control block diagram of a deterioration compensation system according to an embodiment of the present disclosure.

Referring to FIG. 3, the deterioration compensation system may include the memory 160, a drive amount accumulator 210, a deterioration data controller 212, a compensation data calculator 214, and an image compensator 200.

The memory 160 may store deterioration data of the sub-pixels SP, for example, deterioration data including cumulative drive amounts N-1 and N-2 and compensation data C_data for image compensation. The cumulative drive amounts N-1 and N-2 stored in the memory 160 may be accumulation values of current amounts supplied to each sub-pixel SP in order to display an image after the display panel 150 is shipped. A cumulative drive amount may be updated by adding a current driving amount generated according to operation of the display panel 150 to a previously stored cumulative drive amount and storing the resultant amount. A most recently stored cumulative drive amount N-1 (i.e., (N-1)-th stored deterioration data) and a previously stored cumulative drive amount N-2 (i.e., (N-2)-th stored deterioration data) may be stored in the memory 160. Further, the compensation data C_data (i.e., (N-1)-th compensation data) for compensating for deterioration of the sub-pixels SP according to the most recently stored cumulative drive amount N-1 may be stored in the memory 160. The compensation data C_data stored in the memory 160 may be applied to currently input image data.

The drive amount accumulator 210 may calculate a current usage of the sub-pixels according to compensated image data DATA' displayed on the display panel 150. The drive amount accumulator 210 may accumulate a current usage of each sub-pixel SP to calculate a current usage N' from frame data included in the compensated image data DATA' output to the display panel 150. The drive amount accumulator 210 may calculate a current usage per sub-pixel SP or group a plurality of sub-pixels SP into a group and calculate a current usage per color of each block.

The deterioration data controller 212 may determine whether to store the currently accumulated current usage N' as a cumulative drive amount in the memory 160. According to a determination result, the deterioration data controller 212 may add the currently accumulated current usage N' (i.e., newly generated deterioration data) to the most recently stored cumulative drive amount N-1 and store a current cumulative drive amount N (i.e., N-th deterioration data) in the memory 160 as deterioration data. The deterioration data controller 212 loads the most recently stored cumulative drive amount N-1 (i.e., N-1th deterioration data) and the previously stored cumulative drive amount N-2 (i.e., N-2th deterioration data) from the memory 160 and calculates a difference (N-1)-(N-2) therebetween to calculate a most recently added current usage (N-1)' (i.e., the previous deterioration data). The deterioration data controller 212 compares the most recently added current usage (N-1)' to the currently accumulated current usage N' (i.e., the cumulative current drive amount), when a difference therebetween is equal to or greater than a threshold, reflects the currently accumulated current usage N' in deterioration data, and stores the deterioration data in the memory 160. The deterioration data controller 212 may add the currently accumulated current usage N' to the most recently stored cumulative drive amount N-1 to calculate the current cumulative drive amount N and store the current cumulative drive amount N in the memory 160. Here, the threshold that is a criterion for determining whether to store a cumulative drive amount may be set to a specific value depending on deterioration characteristics of the display panel.

The compensation data calculator 214 may calculate compensation data C_data for correcting image data on the basis of the current cumulative drive amount N to update previous compensation data stored in the memory 160. The compensation data calculator 214 may predict a deterioration amount of the sub-pixels SP on the basis of the current cumulative drive amount N and calculate a compensation gain suitable for a target as compensation data. The compensation data calculator 214 may calculate compensation data using a formula for calculating compensation data based on a cumulative drive amount of sub-pixels or using a graph of compensation data according to cumulative drive amounts or a look-up table storing compensation data according to cumulative drive amounts.

The image compensator 200 may apply the compensation data C_data to the input image data DATA to output the compensated image data DATA'. The image compensator 200 may generate output image data DATA' in which decrease in luminance and efficiency due to deterioration of the sub-pixels SP has been compensated using the compensation data C_data and output the output image data DATA'.

The deterioration compensation system according to the embodiment of the present disclosure having the above-described configuration may reflect the currently accumulated current usage N' in deterioration data and store the same in the memory 160 when a difference between the currently accumulated current usage N' and the most recently added current usage (N-1)' is equal to or greater than the threshold, and compensate for input image data DATA on the basis of the deterioration data stored in the memory 160 to generate output image data DATA'. In this deterioration compensation system, components other than the memory 160 may be included in the timing controller 120 in the form of a program or logic.

Figure 4:
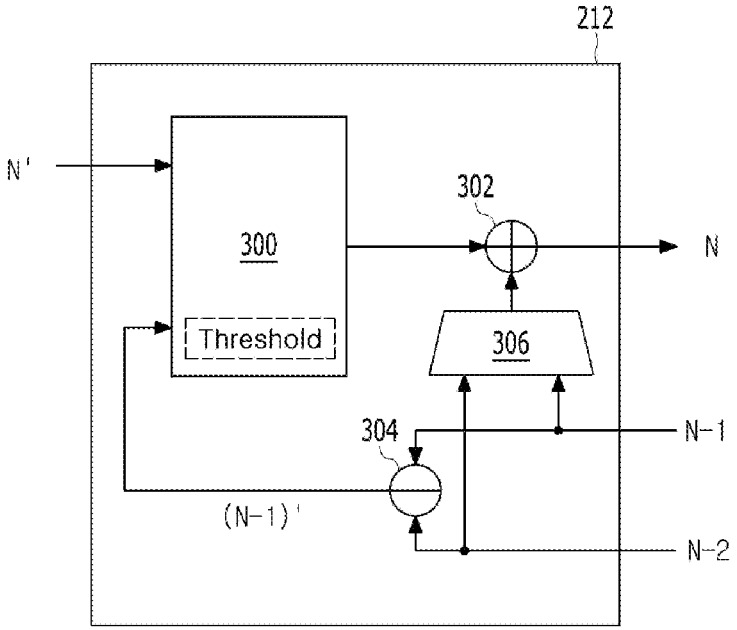
FIG. 4 is a control block diagram of a deterioration data controller of FIG. 3.

FIG. 4 is a control block diagram of the deterioration data controller 212 of FIG. 3. The deterioration data controller 212 may reflect the currently accumulated current usage N' in deterioration data and store the current deterioration data in the memory 160 when a difference between the currently accumulated current usage N' and the most recently added current usage (N-1)' is equal to or greater than the threshold. To perform this process, the deterioration data controller 212 may include a comparator 300, a subtractor 304, an adder 302, and a backup memory 306.

The backup memory 306 may store data loaded from the memory 160 for arithmetic operation and arithmetic operation data. For example, the backup memory 306 may store the most recently stored cumulative drive amount N-1 and the previously stored cumulative drive amount N-2 loaded from the memory 160. The backup memory 306 cannot preserve data in a state in which power is not supplied thereto but can be implemented as a dynamic random access memory (DRAM), a static random access memory (SRAM), or the like which can process data at a relatively high speed.

The subtractor 304 calculates a difference between the most recently stored cumulative drive amount N-1 and the previously stored cumulative drive amount N-2 and outputs the most recently added current usage (N-1)' to the comparator 300.

The comparator 300 compares the currently accumulated current usage N' to the most recently added current usage (N-1)'. The comparator 300 outputs the currently accumulated current usage N' to the adder 302 when a difference between the currently accumulated current usage N' and the most recently added current usage (N-1)' is equal to or greater than a prestored threshold.

The adder 302 adds the currently accumulated current usage N' output from the comparator 300 to the most recently stored cumulative drive amount N-1 to output a current cumulative drive amount N.

The current cumulative drive amount N output from the deterioration data controller 212 is stored in the memory 160 that is a nonvolatile memory.

As described above, the deterioration data controller 212 according to the embodiment of the present disclosure updates the current cumulative drive amount N when a difference between the currently accumulated current usage N' and the most recently added current usage (N-1)', that is, a deterioration increase range, is equal to or greater than the prestored threshold.

Figure 5:
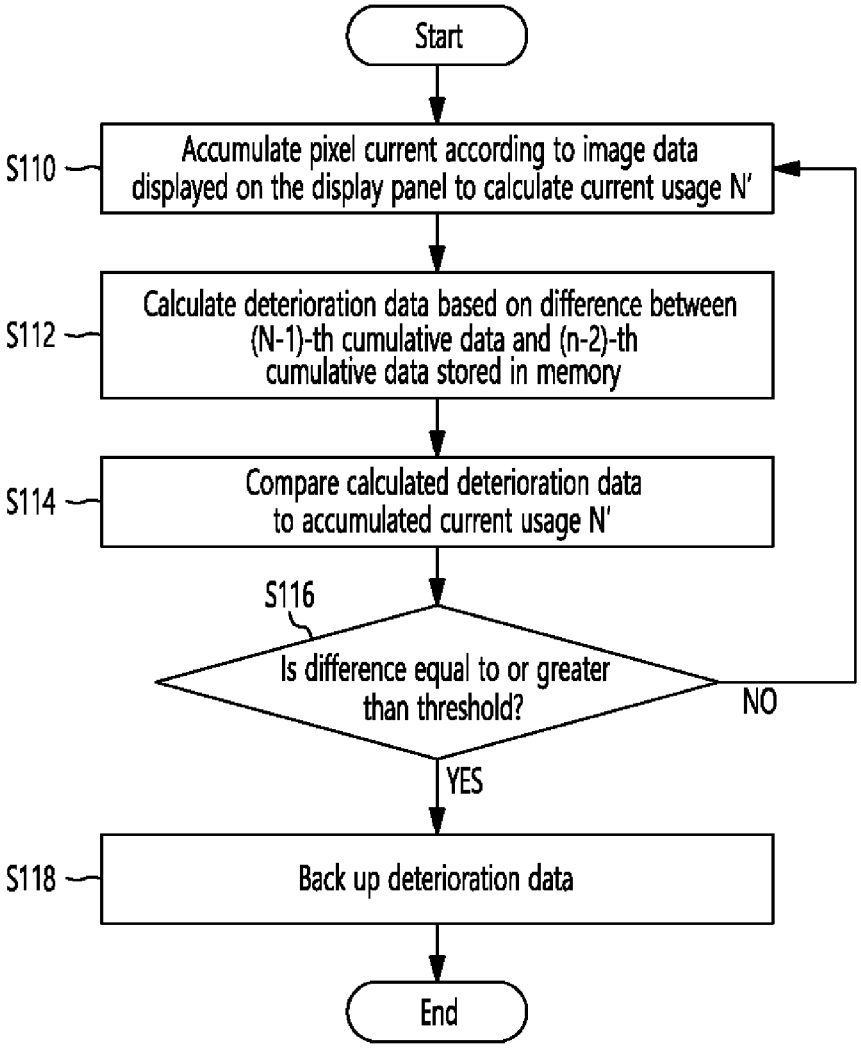
FIG. 5 is a control flowchart of the deterioration compensation system according to an embodiment of the present disclosure.

FIG. 5 is a control flowchart of a deterioration compensation system according to an embodiment of the present disclosure.

A current usage per sub-pixel SP may be accumulated according to compensated image data DATA' displayed on the display panel 150 to calculate a current usage N' (S110). Here, the current usage N' may be calculated per sub-pixel SP, or sub-pixels SP may be grouped and a current usage per color of each group may be calculated.

A difference between the most recently stored cumulative drive amount N-1 (i.e., (N-1)-th cumulative data) and the previously stored cumulative drive amount N-2 (i.e., (N-2)-th cumulative data) stored in the memory 160 is calculated to calculate previous deterioration data (S112).

The calculated deterioration data is compared to the accumulated current usage N' (S114) and it is determined whether a difference therebetween is equal to or greater than the threshold (S116).

Upon determining that the difference between the currently accumulated current usage N' and the most recently added current usage (N-1)' is equal to or greater than the threshold, the currently accumulated current usage N' is reflected in deterioration data and backed up in the memory (S118).

FIG. 6 to FIG. 9 are graphs for describing a deterioration compensation method according to an embodiment of the present disclosure.

Figure 6:
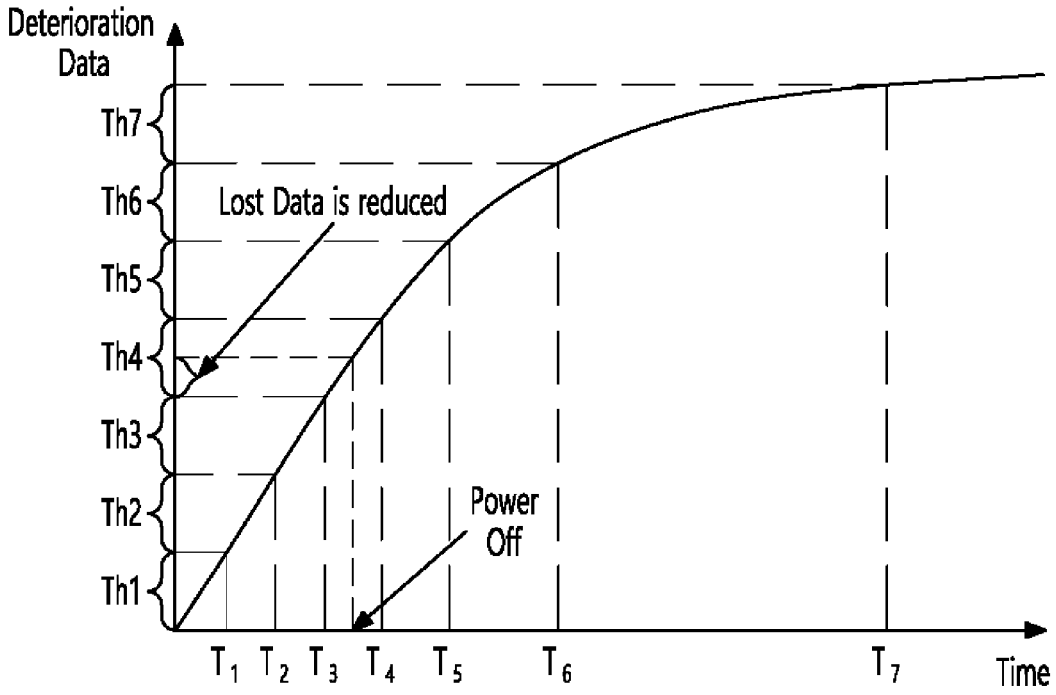
FIG. 6 to FIG. 9 are graphs for describing a deterioration compensation method according to the embodiment of the present disclosure.
Figure 7:
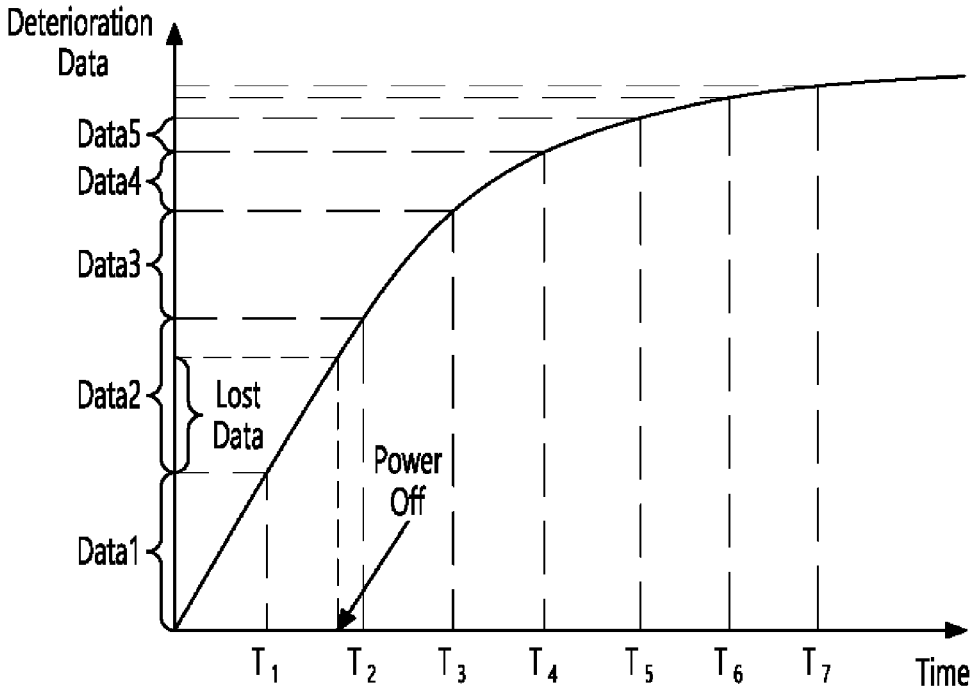

FIG. 6 and FIG. 7 are graphs for describing the relationship between driving time of a display panel and deterioration data backup time, FIG. 6 is a graph according to an embodiment of the present disclosure and FIG. 7 is a graph according a comparative example.

In the graphs of FIG. 6 and FIG. 7, X axis represents a driving time and Y axis represents a deterioration data amount. As shown in the graphs, the deterioration data amount increases as the display panel driving time increases. The deterioration data amount of the display panel has characteristics that it sharply increases in an early operation stage of the display panel and an increase range of deterioration data decreases after deterioration has progressed.

Referring to FIG. 6 showing an embodiment of the present disclosure, the present disclosure sets an increase range of the deterioration data to a threshold and backs up the deterioration data at a time at which the amount of deterioration data has increased by the threshold. That is, the deterioration data is backed up at a time T1 at which the amount of deterioration data has increased by Th1, and when the amount of deterioration data has increased by the threshold and has been accumulated by Th2 at a time T2, the accumulated deterioration data Th2 is backed up at the time T2. Thereafter, the deterioration data is backed up at a time T3 at which the deterioration data has been accumulated by Th3, at a time T4 at which the deterioration data has been accumulated by Th4, at a time T5 at which the deterioration data has been accumulated by Th5, at a time T6 at which the deterioration data has been accumulated by Th6, and at a time T7 at which the deterioration data has been accumulated by Th7.

When an increase range of deterioration data is set to the threshold and the deterioration data is backed up, a deterioration data backup interval decreases as T1, T2, T3, and in an early operation stage in which the amount of deterioration data sharply increases. On the other hand, the deterioration data backup interval increases as T5, T6, and T7 when the increase range of the deterioration data is reduced.

As described above, backup frequency is high because the backup period is short in an early operation stage in which a deterioration rate is high, and thus accuracy of compensation data can be improved. In addition, even if deterioration data cannot be backed up due to power off in an early operation stage in which the deterioration rate is high, the amount of lost data can be minimized. On the other hand, after deterioration has progressed, the increase range of the deterioration data and backup frequency are reduced, and thus the lifespan of the memory can be improved.

Referring to FIG. 7 showing a comparative example, a conventional deterioration data backup method backs up deterioration data at regular intervals. That is, the deterioration data Data 1 to Data 5 is backed up at a time T1 to a time T7 at regular intervals.

As shown in FIG. 7, when the deterioration data is backed up at regular intervals, the accuracy of compensation data decreases in an early operation stage in which the amount of deterioration data sharply increases. In addition, when the deterioration data cannot be backed up due to power off in an early operation stage in which a deterioration rate is high, the amount of lost data increases as compared to embodiments of the present disclosure, and thus the accuracy of compensation data may decrease.

After deterioration has progressed, the increase range of the deterioration data is reduced, but the deterioration data is backed up at regular intervals in the comparative example. Accordingly, the lifespan of the memory may be reduced because backup is performed at regular intervals even when deterioration data hardly changes and thus need not be backed up.

As described above through comparison, the deterioration data backup method according to the embodiment of the present disclosure backs up deterioration data by setting an increase range of the deterioration data to the threshold. Accordingly, backup frequency can be increased to improve the accuracy of compensation data and the amount of lost data due to power off before backup can be minimized in an early operation stage in which a deterioration rate is high. On the other hand, when the increase range of deterioration data is reduced, backup frequency is also reduced and thus the lifespan of the memory can be improved.

Figure 8:
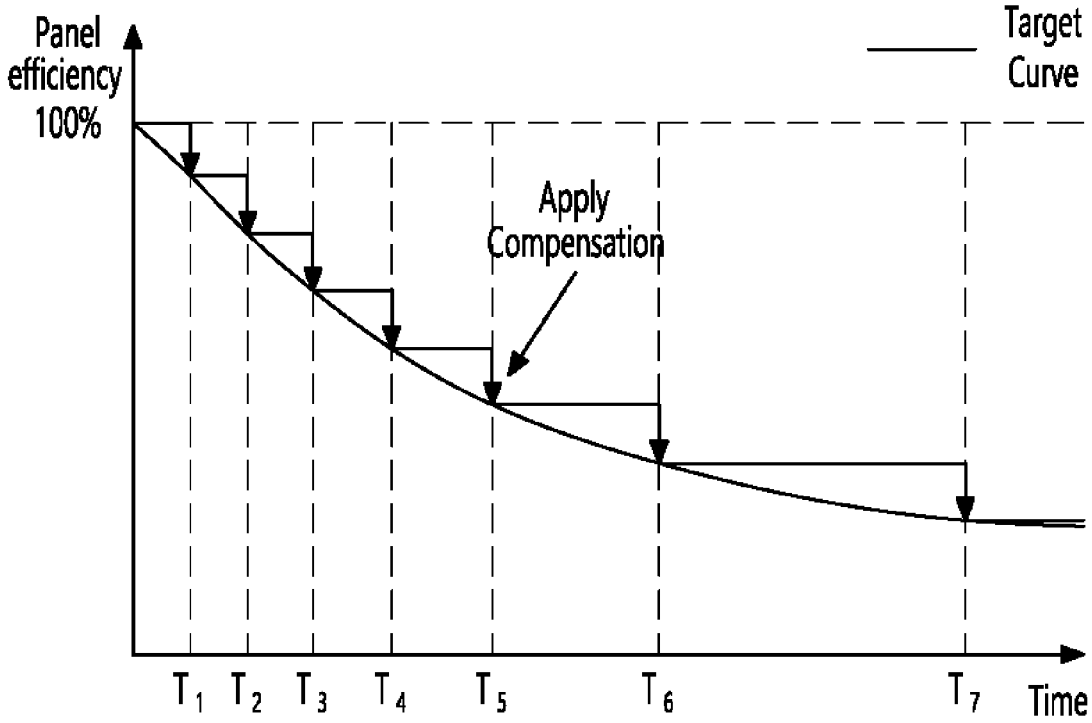
Figure 9:
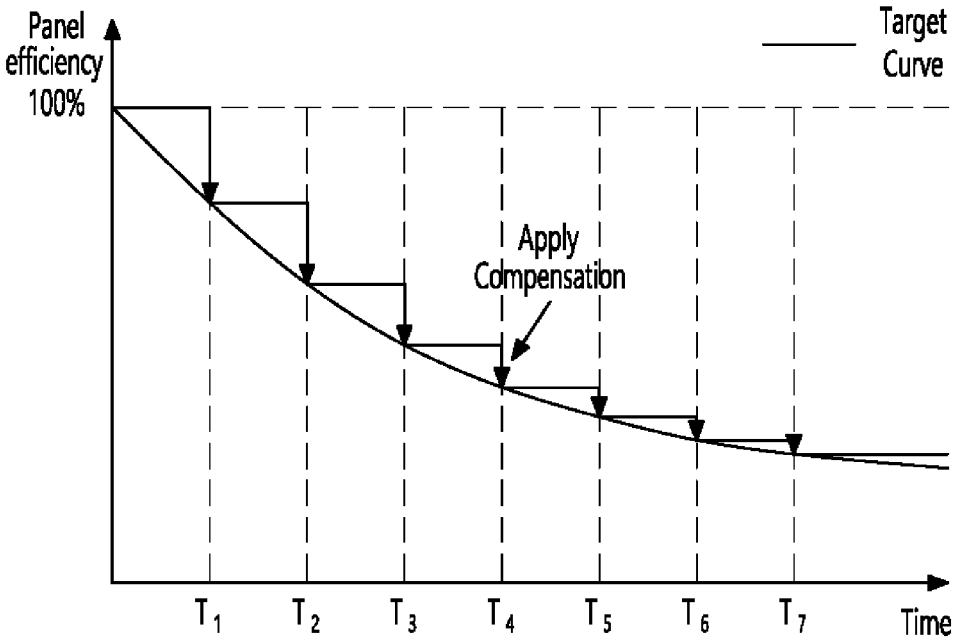

FIG. 8 and FIG. 9 are graphs for describing the relationship between a deterioration data backup time and panel efficiency, FIG. 8 is a graph according to an embodiment of the present disclosure and FIG. 9 is a graph according to a comparative example.

In the graphs of FIG. 8 and FIG. 9, the X axis represents a driving time and the Y axis represents panel efficiency. As shown in the graphs, panel efficiency of the display panel decreases as the display panel driving time increases. The panel efficiency has characteristics that it sharply decreases in an early operation stage and a decrease range thereof is reduced as the driving time increases.

Referring to FIG. 8 showing an embodiment of the present disclosure, since a deterioration data backup interval of the present disclosure is determined by an increase range of the deterioration data, the deterioration data backup interval is shortened as T1, T2, T3, and T4 and increases as T5, T6, and T7 as the driving time increases.

When the deterioration data is backed up, compensation data is updated and applied according to the backup deterioration data. Accordingly, in an early operation stage in which the panel efficiency sharply decreases, as shown in FIG. 8, a deterioration data backup frequency is high and thus compensation data update and application frequency is also high. Accordingly, the compensation performance in an early operation stage can be improved.

Referring to FIG. 9 showing a comparative example, a conventional deterioration data backup method backs up deterioration data at regular intervals. That is, the deterioration data is backed up at a time T1 to a time T7 at regular intervals and compensation data is updated and applied according to backup deterioration data.

As shown in FIG. 9, when the deterioration data is backed up and compensated at regular intervals, as shown in FIG. 9, the accuracy of compensation data decreases in early operation stage in which the amount of deterioration data sharply increases. Accordingly, the compensation performance in an early operation stage may deteriorate.

As described above, the display device and the method for controlling the same according to the present disclosure back up deterioration data by setting an increase range of the deterioration data to the threshold. Accordingly, it is possible to increase backup frequency to improve the accuracy of compensation data in an early operation stage in which a deterioration rate is high and to decrease the backup frequency to improve the lifespan of the memory when deterioration has considerably progressed.

It will be apparent to those skilled in the art that various modifications and variations can be made in the present disclosure without departing from the spirit or scope of the invention. Thus, the scope of the present disclosure should be determined by the appended claims and their legal equivalents, not by the above description.

The display device and the method for controlling the same according to the present disclosure can improve the lifespan of a memory for deterioration compensation by differently setting a backup period of data with respect to deterioration compensation depending on degrees of deterioration of pixels.

Furthermore, it is possible to increase backup frequency to improve the accuracy of compensation data in an early operation stage in which a deterioration rate is high and to decrease the backup frequency to improve the lifespan of a flash memory when deterioration has considerably progressed.

Effects which may be obtained by the present disclosure are not limited to the above-described effects, and various other effects may be evidently understood by those skilled in the art to which the present disclosure pertains from the following description.

What is claimed is:

1. A display device comprising:

a display panel including a plurality of pixels;

a memory in which deterioration data of the pixels is accumulated and stored and compensation data corresponding to the deterioration data is stored; and a controller configured to apply the compensation data to input image data to generate output image data for display on the display panel, and when an increase amount of the deterioration data of the pixels generated as the output image data is displayed on the display panel is equal to or greater than a threshold, to accumulate the increase amount of the deterioration data to store the deterioration data in the memory.

2. The display device according to claim 1, wherein the controller increases a deterioration data storage interval as a cumulative driving time of the display panel increases.

3. The display device according to claim 1, wherein the controller decreases a deterioration data storage frequency as the cumulative driving time of the display panel increases.

4. The display device according to claim 1, wherein the memory includes (N-1)-th stored deterioration data, (N-2)-th stored deterioration data, and (N-1)-th compensation data for compensating for the (N-1)-th stored deterioration data.

5. The display device according to claim 4, wherein the controller calculates previous deterioration data on the basis of a difference between the (N-2)-th stored deterioration data and the (N-1)-th stored deterioration data, when a difference between newly generated deterioration data generated as output image data compensated according to the (N-1)-th compensation data is displayed on the display panel and the previous deterioration data is equal to or greater than the threshold, accumulates the newly generated deterioration data in addition to the (N-1)-th stored deterioration data, and stores the accumulated data as N-th deterioration data.

6. The display device according to claim 1, wherein the controller includes:

a drive amount accumulator configured to accumulate current drive amounts of the pixels on the basis of the output image data output to the display panel;

a deterioration data controller configured to determine whether the increase amount of the deterioration data is equal to or greater than the threshold on the basis of deterioration data previously stored in the memory and a cumulative current drive amount of the drive amount accumulator, to reflect the cumulative current drive amount in the deterioration data when the increase amount of the deterioration data is equal to or greater than the threshold, and to accumulate and store the deterioration data in the memory; and a compensation data calculator configured to calculate compensation data corresponding to the deterioration data to update previous compensation data in the memory.

7. The display device according to claim 6, wherein the deterioration data controller includes:

a subtractor configured to load (N-1)-th deterioration data and (N-2)-th deterioration data stored in the memory and to calculate a difference value between the (N-1)-th deterioration data and the (N-2)-th deterioration data;

a comparator configured to compare a difference between the difference value and the cumulative current drive amount to the threshold and to output the cumulative current drive amount if the difference is equal to or greater than the threshold; and an adder configured to add the cumulative current drive amount to the (N-1)-th deterioration data and to output N-th deterioration data to the memory.

8. The display device according to claim 6, wherein the controller includes an image compensator configured to apply the compensation data to the input image data to generate the output image data in which deterioration of the pixels has been compensated.

9. A method for controlling a display device including a display panel including a plurality of pixels, and a memory in which deterioration data of the pixels is accumulated and stored and compensation data corresponding to the deterioration data is stored, the method comprising:

applying the compensation data to input image data to generate output image data for display on the display panel;

accumulating the deterioration data of the pixels generated as the output image data is displayed on the display panel; and accumulating an increase amount of the deterioration data and storing the deterioration data in the memory if the increase amount of the deterioration data is equal to or greater than a threshold.

10. The method according to claim 9, wherein a deterioration data storage interval increases as a cumulative driving time of the display panel increases.

11. The method according to claim 9, wherein a deterioration data storage frequency decreases as the cumulative driving time of the display panel increases.

12. The method according to claim 9, wherein the accumulating deterioration data of the pixel generated as the output image data is displayed on the display panel comprises accumulating a current drive amount of the pixels on the basis of the output image data.

13. The method according to claim 12, wherein the storing the deterioration data in the memory if the increase amount of the deterioration data is equal to or greater than a threshold comprises:

calculating previous deterioration data on the basis of a difference between (N-2)-th deterioration data and (N-1)-th deterioration data stored in the memory;

determining whether a difference between an accumulation value of the current drive amount of the pixels and the previous deterioration data is equal to or greater than the threshold; and reflecting the accumulation value of the current drive amount of the pixels in the (N-1)-th stored deterioration data and storing the resultant value as N-th deterioration data if the difference is equal to or greater than the threshold.

14. A display device comprising:

a display panel including a plurality of pixels;

a memory in which deterioration data of the pixels is accumulated and stored and compensation data corresponding to the deterioration data is stored; and a controller configured to apply the compensation data to input image data to generate output image data for display on the display panel, and to accumulate an increase amount of the deterioration data of the pixels generated as the output image data is displayed on the display panel and to store the deterioration data in the memory at irregular deterioration data storage intervals determined according to the increase amount of the deterioration data of the pixels.

15. The display device according to claim 14, wherein the controller decreases the deterioration data storage interval as a cumulative driving time of the display panel increases in a first range of the cumulative driving time.

16. The display device according to claim 15, wherein the controller increases the deterioration data storage interval as the cumulative driving time of the display panel increases in a second range of the cumulative driving time greater than the first range of the cumulative driving time.

17. The display device according to claim 14, wherein the controller updates the deterioration data in the memory at an increasing frequency in a first range of efficiency drop of the display panel.

18. The display device according to claim 17, wherein the controller updates the deterioration data in the memory at a decreasing frequency in a second range of efficiency drop of the display panel greater than the first range of efficiency drop of the display panel.

19. The display device according to claim 14, wherein the controller includes:

a drive amount accumulator configured to accumulate current drive amounts of the pixels on the basis of the output image data output to the display panel;

a data controller configured to determine whether the increase amount of the deterioration data is equal to or greater than the threshold on the basis of deterioration data previously stored in the memory and a cumulative current drive amount of the drive amount accumulator, to reflect the cumulative current drive amount in the deterioration data when the increase amount of the deterioration data is equal to or greater than the threshold, and to accumulate and store the deterioration data in the memory; and a compensation data calculator configured to calculate compensation data corresponding to the deterioration data to update previous compensation data in the memory.

20. The display device according to claim 19, wherein the deterioration data controller includes:

a subtractor configured to load (N-1)-th deterioration data and (N-2)-th deterioration data stored in the memory and to calculate a difference value between the (N-1)-th deterioration data and the (N-2)-th deterioration data;

a comparator configured to compare a difference between the difference value and the cumulative current drive amount to the threshold and to output the cumulative current drive amount if the difference is equal to or greater than the threshold; and an adder configured to add the cumulative current drive amount to the (N-1)-th deterioration data and to output N-th deterioration data to the memory.

* * * * *